US011007666B2

(12) United States Patent
Yamamoto et al.

(10) Patent No.: US 11,007,666 B2
(45) Date of Patent: May 18, 2021

(54) CUTTING MACHINE

(71) Applicant: Roland DG Corporation, Hamamatsu (JP)

(72) Inventors: Shinya Yamamoto, Hamamatsu (JP); Masakazu Igarashi, Hamamatsu (JP); Takeshi Tozuka, Hamamatsu (JP); Tetsuhiro Kunifuji, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 0 days.

(21) Appl. No.: 16/874,487

(22) Filed: May 14, 2020

(65) Prior Publication Data

US 2020/0276726 A1 Sep. 3, 2020

Related U.S. Application Data

(63) Continuation of application No. PCT/JP2019/046435, filed on Nov. 27, 2019.

(30) Foreign Application Priority Data

Nov. 30, 2018 (JP) ..... 2018-225391

(51) Int. Cl.
*B26F 1/00* (2006.01)
*B41J 11/70* (2006.01)

(52) U.S. Cl.
CPC ..... *B26F 1/0092* (2013.01); *B41J 11/70* (2013.01)

(58) Field of Classification Search
None
See application file for complete search history.

(56) References Cited

U.S. PATENT DOCUMENTS

| | | | | |
|---|---|---|---|---|
| 9,927,802 | B2 * | 3/2018 | Nagai | G05B 19/4097 |
| 2013/0008292 | A1 * | 1/2013 | Kawaguchi | B26F 1/3813 83/76.1 |
| 2013/0104713 | A1 | 5/2013 | Kawaguchi et al. | |

FOREIGN PATENT DOCUMENTS

| | | | |
|---|---|---|---|
| JP | H02-243292 | A | 9/1990 |
| JP | 1990-262995 | | 10/1990 |
| JP | H06-024668 | A | 2/1994 |
| JP | H06-024688 | A | 2/1994 |
| JP | H061-55383 | A | 6/1994 |
| JP | H06-246685 | A | 9/1994 |
| JP | 1995-39229 | | 5/1995 |
| JP | H07-237183 | A | 9/1995 |
| JP | 2013-091133 | A | 5/2013 |

* cited by examiner

*Primary Examiner* — Alejandro Valencia
(74) *Attorney, Agent, or Firm* — Knobbe, Martens, Olson & Bear, LLP

(57) ABSTRACT

A cutting machine can be configured to set a cutting line with respect to a cutting material that is placed on a supporting platform, cut the cutting material along one cutting line that intersect with and changes direction at a second cutting line at a corner portion, leaving a part of the cutting material connected along a predetermined distance from a point of intersection of the corner portion, and cutting along the other cutting line so as to not leave a connected part, up to a predetermined distance from the point of intersection of the corner portion.

11 Claims, 11 Drawing Sheets

FIG. 13
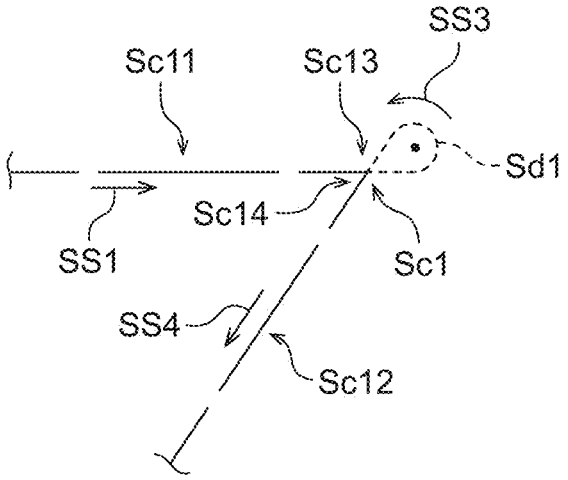
FIG. 14
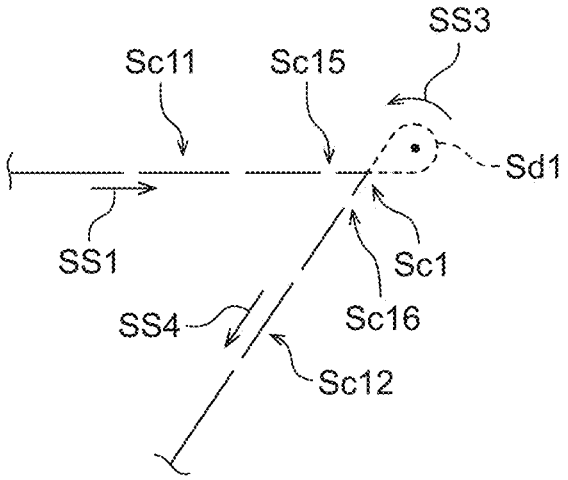
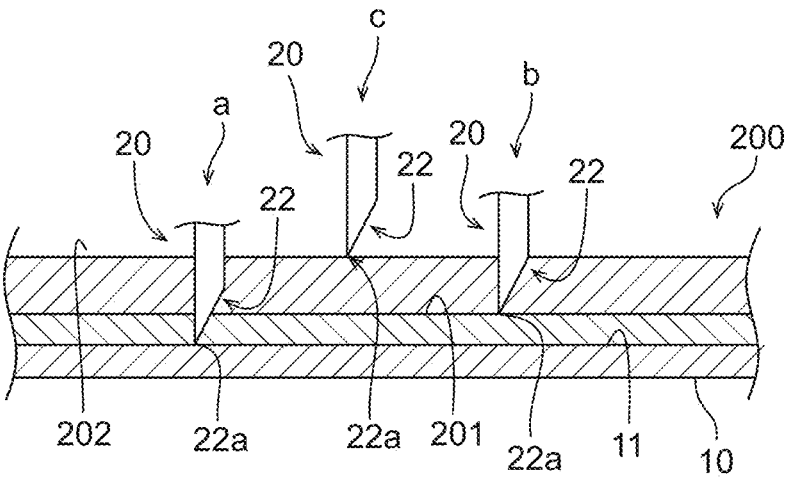
FIG. 15

CUTTING MACHINE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTIONS

Field of the Technology

The present inventions relate to cutting machines.

Description of the Related Art

Japanese Unexamined Patent Application Publication 1990-262995 discloses a method for controlling a blade of a cutting machine wherein, when changing the direction of the cutting blade, the cutting blade is first lifted away from the material being cut, and moved to the starting position for the next cut prior to execution of the next cutting operation in a different direction.

Japanese Unexamined Patent Application Publication 1995-39229 discloses a cutter which performs a so-called "perforation cut," wherein perforations are formed along a line for making a sheet material tearable. In this publication, the perforations are formed in a sheet material by reducing, for a brief interval or regular time intervals, the tool pressure of a cutter that is pressed against the sheet, to produce a state wherein the cutter rides over the sheet surface or moves partially within the sheet.

SUMMARY OF THE INVENTIONS

With some known cutters, such as those described in Japanese Unexamined Patent Application Publication 1990-262995 and 1995-39229, when changing the direction along which the cutter cuts a sheet from one direction to another direction, if the angle of the change in direction is large, the blade of the cutter might get caught on the sheet, or it might not be possible to change the direction smoothly, or the blade of the cutter might become bound with the sheet material at the position where the direction is changed.

Cutting machines disclosed herein can comprise a supporting platform, a cutter, a cutter carriage, a moving mechanism, and a controlling device. The cutter can have a shaft and a blade that is formed at a tip end of the shaft. The cutter carriage can have a holding portion for holding the shaft of the cutter so as to enable rotation. The moving mechanism can be a mechanism for moving the cutter carriage relative to the supporting platform.

The controlling device can be configured so that the following processes (a) through (c) are executed:

(a) setting a cutting line with respect to the material to be cut, which is placed on the supporting platform;

(b) cutting the material on a cutting line of a first cutting line or a second cutting line that form a corner portion where the direction of the cutting line turns, while leaving a connected part in which the material is not cut, at a distance that is determined in advance from the point of intersection at the corner portion, so as to cut along the cutting line except for the connected part; and (c) cutting the material on the other cutting line so as to not leave a connected part, at a distance that is predetermined from the point of intersection at corner portion.

Such a cutting machine can create a sharper, cleaner corner portion where a cutting line includes a corner.

BRIEF DESCRIPTION OF THE DRAWINGS

FIG. 13 is a schematic diagram depicting an example of cutting up the corner portion Sc1.

FIG. 14 is a schematic diagram depicting an example of cutting up the corner portion Sc1.

FIG. 15 is a schematic diagram depicting a pattern for the position of the blade 22 when a material with a seal is adhered onto a backing sheet is the cutting material 200.

DETAILED DESCRIPTION OF PREFERRED EMBODIMENTS

Embodiments of cutting machines disclosed herein are explained below in reference to the drawings. Note that the embodiments explained herein are, of course, not intended to limit the present inventions.

Figure 1:
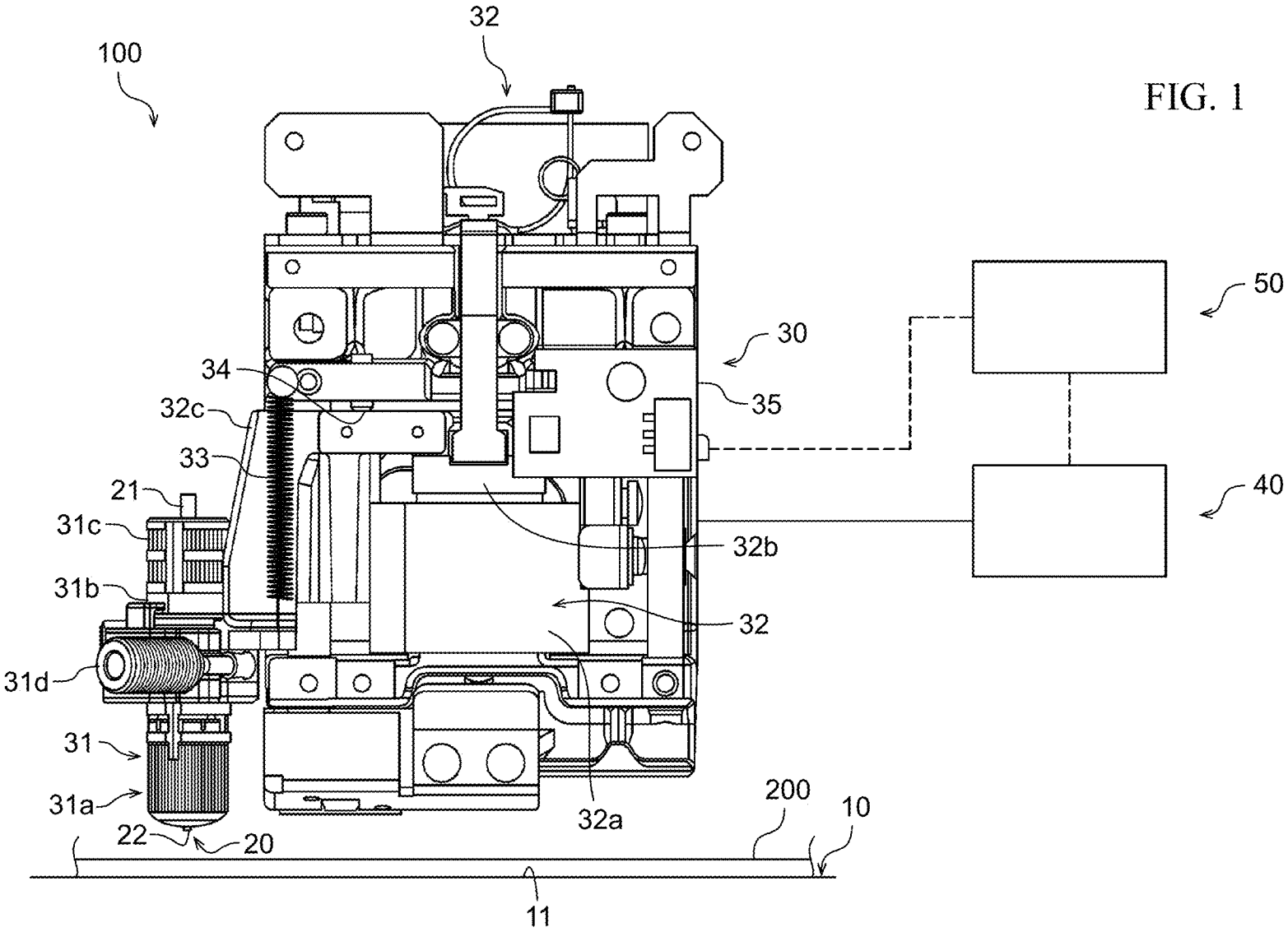
FIG. 1 is a front view depicting a structure for a cutting machine 100.

FIG. 1 is a front view depicting a structure for the cutting machine 100.

The cutting machine 100 comprises a supporting platform 10, a cutter 20, a cutter carriage 30, a moving mechanism 40, and a controlling device 50. In FIG. 1, the cutter carriage 30 is depicted in a state wherein the cover on the front face thereof is removed, to reveal the internal structure thereof.

The supporting platform 10 is a member on which the cutting material is placed. The supporting platform 10 has, for example, a supporting face 11 on which is placed the material that is to be cut, which can be a sheet material. The cutter 20 is a member for cutting the material that is to be cut.

Figure 2:
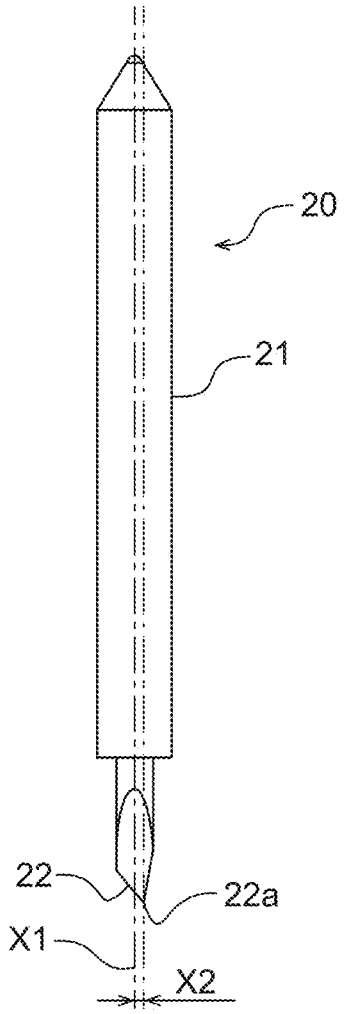
FIG. 2 is a front view of a cutter 20.

FIG. 2 is a front view of the cutter 20. The cutter 20 has a shaft 21 and a blade 22 that is formed on the tip end of the shaft 21. The cutter 20 can be referred to as a cutter blade assembly 20. In this embodiment, the tip end 22*a* of the blade 22 is offset with respect to a centerline X1 of the shaft 21 of the cutter 20. Here the distance with which the tip end 22*a* of the blade 22 is offset in respect to the centerline X1 of the shaft 21 of the cutter 20 shall be termed the "offset distance X2."

Figure 3:
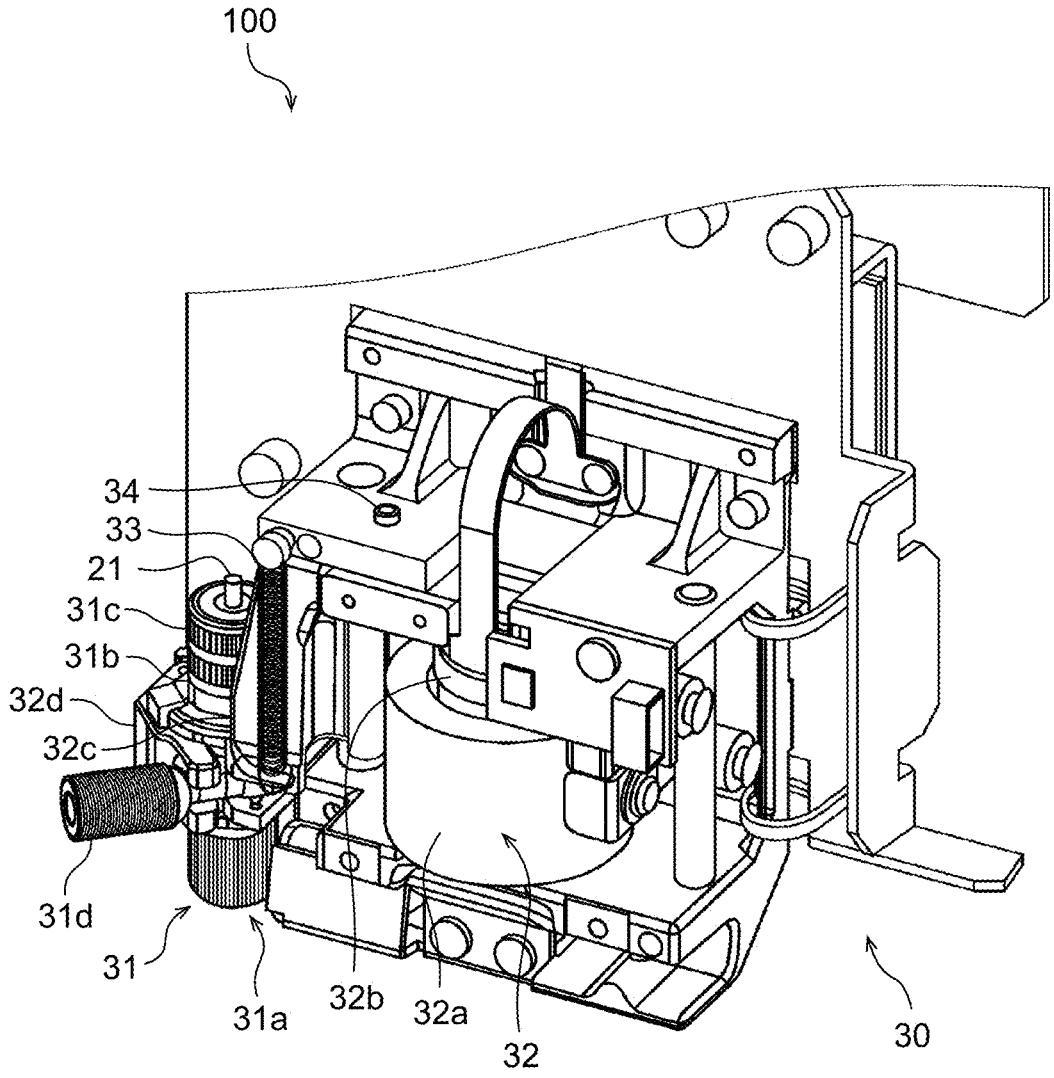
FIG. 3 is a perspective diagram depicting the driving part of a cutter carriage 30 that is driven by a solenoid 32.

The cutter carriage 30 comprises a holding portion 31 and a solenoid 32. FIG. 3 is a perspective diagram depicting the driven part of the cutter carriage 30 that is driven by the solenoid 32. Here the holding portion 31 is a part that holds the shaft 21 of the cutter 20 so as to enable rotation. In the holding portion 31, a chuck 31*a*, for example, that holds the shaft 21 of the cutter 20, may be held by a bearing 31*b*. Through this, the shaft 21 of the cutter 20 is supported by the chuck 31*a* and the bearing 31*b* so as to enable rotation of the shaft 21 about the centerline X1 (FIG. 2). In the present embodiment, while the specific structures for the chuck 31*a* and the bearing 31*b* are omitted from the drawings, in the form depicted in FIG. 1, the structure is such that the chuck 31*a* is opened and closed through rotating an operating screw 31*c*, to attach or remove the cutter 20. Moreover, the structure is such that the chuck 31*a* and bearing 31*b* are removed from the cutter carriage 30 through rotating the operating screw 31*d*. In the holding portion 31 of the cutter carriage 30, the shaft 21 of the cutter 20 is supported in a state wherein the blade 22 of the cutter 20 protrudes from the bottom of the chuck 31*a*.

In the explanation below, FIG. 1 through FIG. 3 may be referenced regarding the cutting machine 100 and the cutting material 200, even if not referenced explicitly. As depicted in FIG. 1 and FIG. 3, the solenoid 32 is structured so as to support the holding portion 31, and so as to raise and lower the holding portion 31 in the cutter carriage 30. Here the cutter carriage 30 is disposed so that a lower portion of the cutter carriage 30 faces the supporting face 11 of the supporting platform 10 whereon the cutting material 200 is supported. The blade 22 of the cutter 20, which protrudes to one side of the holding portion 31, faces the supporting face 11 of the supporting platform 10. In the direction wherein the cutter carriage 30 faces the supporting face 11 of the supporting platform 10, the direction that approaches the supporting face 11 is termed arbitrarily "down," and the direction away from the supporting face 11 is termed arbitrarily "up."

In the present embodiment, the solenoid 32 has a bobbin 32*a* onto which a coil is wound, and a movable core 32*b* (plunger) that is inserted into the bobbin 32*a*. The stroke direction of the movable core 32*b* is oriented in the direction that is perpendicular to the supporting platform 10. In this embodiment, an arm 32*c* is attached to the movable core 32*b*. The arm 32*c* extends downward, on the outside of the bobbin 32*a*, from the top end of the movable core 32*b*. A clamp 32*d*, for gripping the bearing 31*b* of the holding portion 31, is attached to the bottom end portion of the arm 32*c*.

Figure 4:
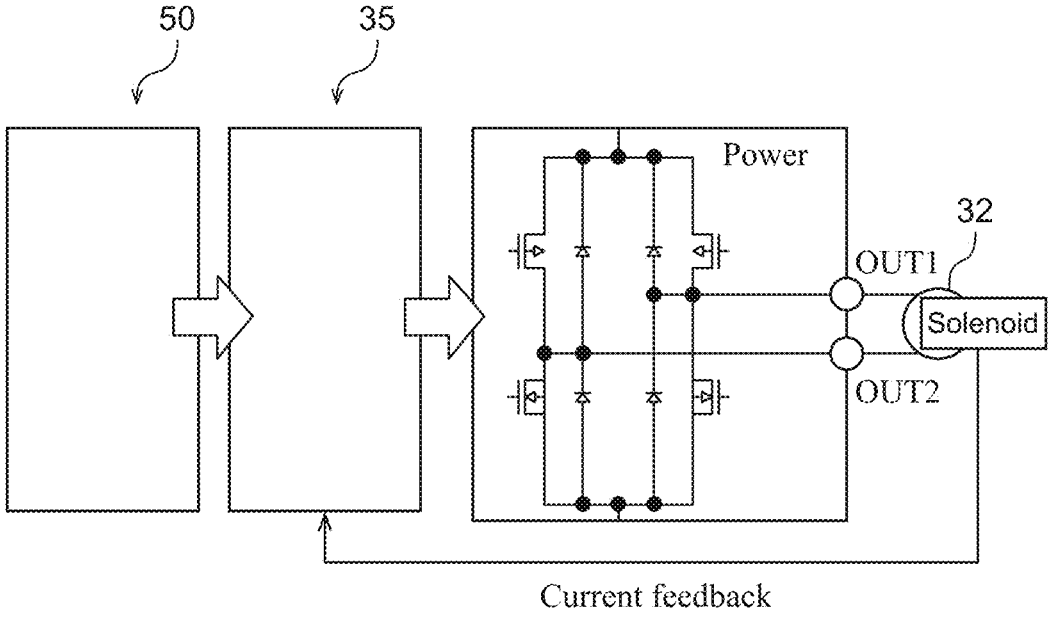
FIG. 4 is a circuit diagram depicting an example of a circuit for controlling the solenoid 32.

FIG. 4 is a circuit diagram depicting an example of a circuit for controlling the solenoid 32. When power is supplied in one direction to the solenoid 32, the holding portion 31 is pushed downward in the cutter carriage 30. Furthermore, through applying power to the solenoid 32 in the opposite direction, the holding portion 31 is lifted upward in the cutter carriage 30. In this way, the structure is such that the holding portion 31 can be raised and lowered relative to the supporting platform 10 through the solenoid 32.

Moreover, the cutter carriage 30 further comprises a spring 33, a shock absorbing material 34, and a first substrate 35 on which is mounted circuitry for operating the solenoid 32. The electric circuit depicted in FIG. 4 is mounted on the first substrate 35. The spring 33 is attached in a state that is tensioned between the arm 32*c* that supports the holding portion 31, and an upper portion of the case of the cutter carriage 30, as depicted in FIG. 1 and FIG. 3, and applies the a force in the direction of lifting the holding portion 31 upwardly, thereby biasing the holding portion 31 towards an upward position. Because of this, when the arm 32*c* is pushed downward by the solenoid 32, the arm 32*c* is pressed downward against the reactive force of the spring 33. Conversely, when the arm 32*c* is pushed upward by the solenoid 32, the arm 32*c* is pulled upward, assisted by the reaction force of the spring 33. In this case, the holding portion 31 is pulled up smoothly, assisted by the reaction force of the spring 33, even if the blade 22 of the cutter 20, which is attached to the holding portion 31, is wedged into the cutting material 200. Moreover, when no power is applied to the solenoid 32, the holding portion 31 will be held in a state wherein it is pulled up to a position away from the cutting material 200.

The shock absorbing material 34 is disposed above the arm 32*c*. The shock absorbing material 34 may be, for example, rubber. When power is applied to the solenoid 32 so as to apply a force to pull the arm 32*c* upward, the arm 32*c* is pulled upward vigorously. The shock absorbing material 34 is attached to a member that is disposed above the arm 32*c*, to mitigate the noise that is produced when the arm 32*c* strikes the member that is disposed thereabove. Moreover, even when no power is applied to the solenoid 32, the arm 32*c* is pulled upward, through the effect of the spring 33, to a position wherein it strikes the shock absorbing material 34.

The moving mechanism 40 is a mechanism that can be configured to move the cutter carriage 30 relative to the supporting platform 10. In the moving mechanism 40, the cutter carriage 30 may be supported in respect to the supporting platform 10 so that the shaft 21 of the cutter 20 will face a direction that is perpendicular to the flat face of the supporting platform 10.

For example, the moving mechanism 40 can be structured so as to move the cutter carriage 30 to an appropriate position with respect to an XY coordinate system that is set parallel to the flat portion of the stationary supporting platform 10 onto which the cutting material 200 is placed. In some embodiments, a first mechanism is configured to move the cutter carriage 30 in the X direction, and a second mechanism is configured to move the cutter carriage 30 in the Y direction. The first and second mechanisms can be combined together. For example, in the first mechanism, the cutter carriage 30 can be attached to a first guide shaft that is disposed along the X direction. In the second mechanism, the first mechanism can be attached to a second guide shaft that is disposed along the Y direction.

Additionally, the configuration may be such that the cutter carriage 30 is moved also in respect to a Z-axis that is perpendicular to the flat portion whereon the cutting material 200 is placed. Note that the moving mechanism 40 is not limited to the form described above. The moving mechanism 40 can instead be a mechanism wherein the supporting platform 10 is moved relative to the cutter carriage 30. Moreover, it can instead be a mechanism for moving both the cutter carriage 30 and the supporting platform 10. For example, it may be a mechanism for moving the cutter carriage 30 in one or two of the directions of an XYZ coordinate system, and for moving the supporting platform 10 in the other direction or directions. Note that while here an orthogonal coordinate system is presented as an example, the movement need not necessarily be along an orthogonal coordinate system. Other coordinate systems can also be used.

Figure 5:
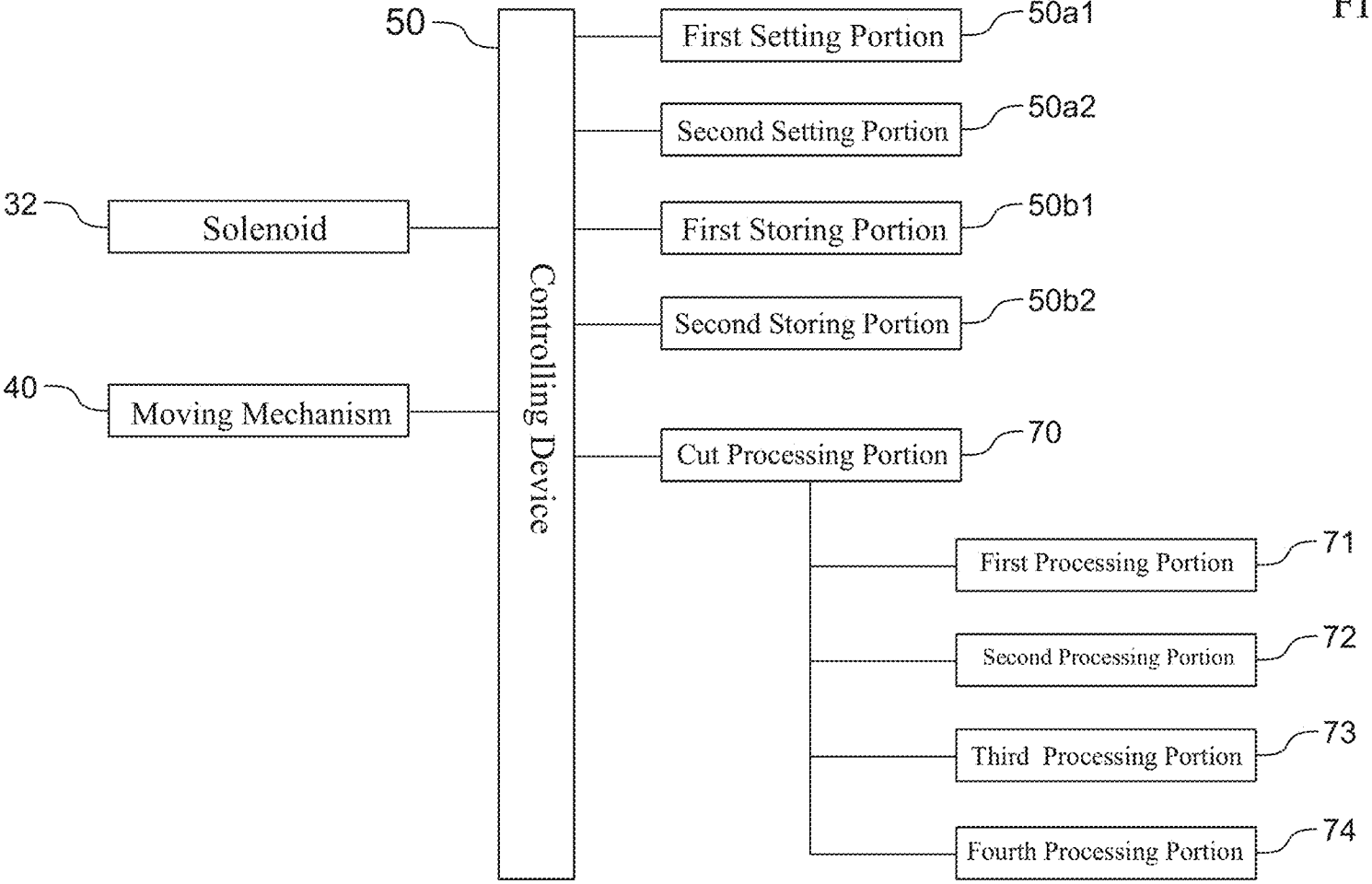
FIG. 5 is a block diagram of a controlling device 50.

FIG. 5 is a block diagram of controlling device 50. The controlling device 50, as depicted in FIG. 5, comprises a first setting portion 50*a*1, a second setting portion 50*a*2, a first storing portion 50*b*1, a second storing portion 50*b*2, and a cut processing portion 70. Here the controlling device 50 is a device configured to control the solenoid 32 of the cutter carriage 30, the moving mechanism 40, and the like, and for controlling the various processes of the cutting machine 100.

The controlling device 50 can be embodied in, for example, a computer that is operated according to a program that has been established in advance. For example, the various functions of the controlling device 50 can be processed through various calculating devices of a computer (also known as a "processors," "CPUs" (Central Processing Units) or "MPUs" (Micro Processing Units)), and storing devices (memories, hard disks, and the like), that define structures within the controlling device 50, in cooperation with software. For example, each of the structures and processes of the controlling device 50 may be embodied in a whole or in part by databases and data structures that store, in a predetermined form, data that is embodied by the computer, processing modules that carry out prescribed calculation processes following programs that have been established in advance, and the like. The controlling device 50 can also be referred to as a "controller".

The first setting portion 50*a*1 can be programmed so as to set cutting lines S1 through S5 with respect to the cutting material 200 that is placed on the supporting platform 10.

Figure 6:
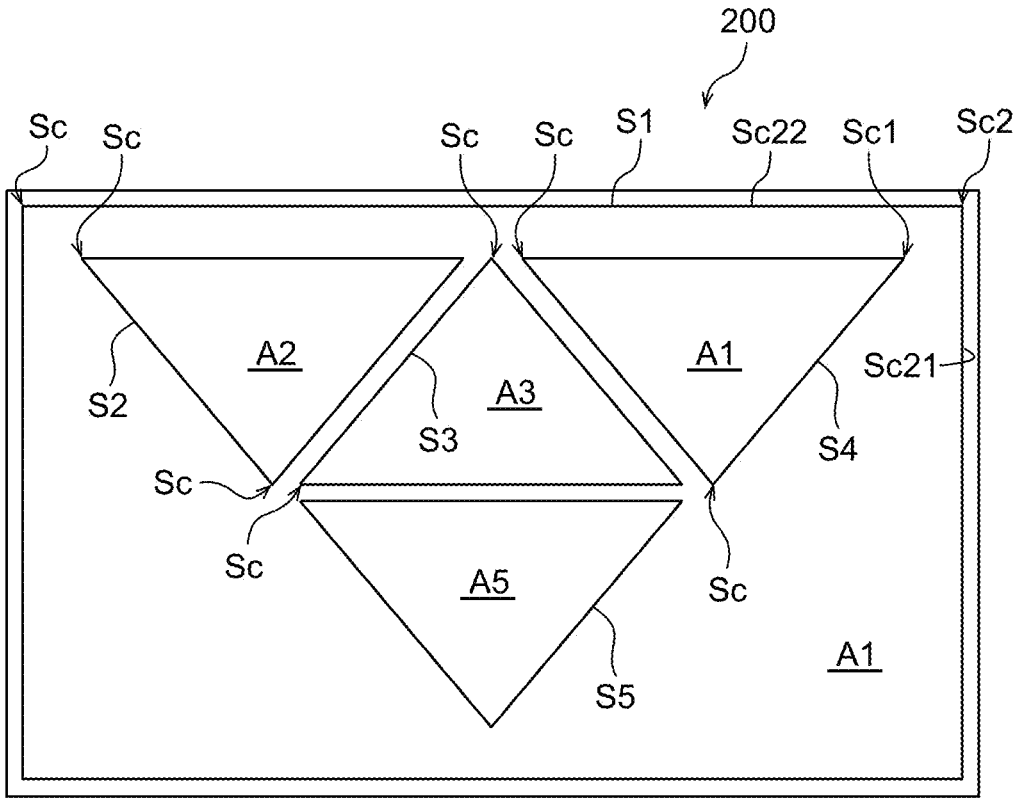
FIG. 6 is a schematic diagram depicting cutting lines S1 through S5 that are set for the cutting material 200.

FIG. 6 is a schematic diagram depicting the cutting lines S1 through S5 that are set for the cutting material 200. In the form depicted in FIG. 6, the cutting lines S1 through S5 are set for the cutting material 200. The cutting line S1 is set so as to encompass a rectangular region A1 along an outer frame of the rectangular cutting material 200. The cutting lines S2 through S5 are set so as to encompass a plurality of triangular regions A2 through A5, respectively, within the rectangular region A1 that is encompassed by the cutting line S1. Here the cutting line S1 that encompasses the rectangular region A1 and the cutting lines S2 through S5 that encompassed the triangular regions A2 through A5 have corner portions Sc wherein the directions of each of the cutting lines S2 through S5 change.

Here the cutting lines S1 through S5 can each be set as paths for the shaft 21 of the cutter 20, in instructions for the cutter carriage 30, for example. In such embodiments, as depicted in FIG. 2, the tip end 22*a* of the blade 22 of the cutter 20 is offset from the centerline X1 of the shaft 21 of the cutter 20. The holding portion 31 supports the shaft 21 of the cutter 20 so as to enable rotation. When the holding portion 31 is operated to cause the tip end 22*a* of the blade 22 of the cutter 20 to contact the cutting material 200, and to move the shaft 21 of the cutter 20 along a cutting line S1 through S5, the shaft 21 of the cutter 20 rotates so that the tip end 22*a* of the blade 22 of the cutter 20 will be to the rear of the shaft 21 of the cutter 20. Through this, the blade 22 of the cutter 20 will face the direction of forward movement. Additionally, the tip end 22*a* of the blade 22 of the cutter 20 will follow behind the shaft 21 of the cutter 20, along the cutting line S1 to S5.

The position wherein the tip end 22*a* of the blade 22 contacts the cutting material 200 may be calculated from the position of the shaft 21 of the cutter 20. That is, the tip end 22*a* of the blade 22 will be to the rear of the centerline X1 of the shaft 21 of the cutter 20, in the direction of forward movement of the blade 22 of the cutter 20, by the offset distance (offset distance X2) of the tip end 22*a* of the blade 22. The controlling device 50 can store the offset distance X2 of the cutter 20 in advance. When the position of the shaft 21 of the cutter 20 is controlled by the movement of the cutter carriage 30, the position of the tip end 22*a* of the blade 22, with respect to the cutting material 200, is calculated depending on this offset distance X2. This enables control of the position at which the blade 22 of the cutter 20 contacts the cutting material 200.

With continued reference to FIG. 5, the cut processing portion 70 can be programmed so as to cut the cutting material along the cutting lines. In some embodiments, the cut processing portion 70 comprises a first processing portion 71, a second processing portion 72, a third processing portion 73, and a fourth processing portion 74.

The first processing portion 71 can be structured so that a first step will be executed. If the cutting line S1 through S5 has at least one corner portion Sc wherein the direction changes, the first step can be a step for moving the blade 22 of the cutter 20 along one cutting line that arrives (or "ends") at the corner portion Sc. In this first step, the blade 22 of the cutter 20 is pressed against the cutting material 200, at at least a portion of one cutting line that arrives at the corner portion Sc, with a force that is set in advance so that the cutting material 200 will be cut.

The second processing portion 72 can be structured so as to execute a second step. The second step can be a step for lifting the tip end 22*a* of the blade 22 of the cutter 20 away from the cutting material 200, after the first step.

In this second step, the tip end 22*a* of the blade 22 of the cutter 20 can be lifted away from the cutting material 200, that is, the tip end 22*a* of the blade 22 of the cutter 20 being separated from the cutting material 200. By separating the cutter 20 from the cutting material 200, the contact between the cutter 20 and the cutting material 200 can be suspended, temporarily. When the contact between the cutter 20 and the cutting material 200 is suspended, the shaft 21 of the cutter 20 becomes free to move in any direction with the holding portion 31.

In this second step, the tip end 22*a* of the blade 22 of the cutter 20 would normally be separated or spaced from the cutting material 200. However, it is possible that in some circumstances, when the cutting material 200 is cut by the cutter 20 in the first step, the tip end 22*a* of the blade 22 of the cutter 20 can become wedged in the cutting material 200. When the tip end 22*a* of the blade 22 of the cutter 20 is wedged as such and lifted from the cutting material 200, a small frictional force may act between the tip end 22*a* of the blade 22 of the cutter 20 and the cutting material 200. When this frictional force is present, the cutting material 200 can be pulled upwardly together with the tip end 22*a* of the blade 22 that is pulled up, so that the cutter 20 and the cutting material 200 remain in contact.

In some embodiments, the structure is such that, in the second step, the cutter 20 is held for a predetermined time interval, in a state wherein it is lifted from the cutting material 200. Maintaining the state wherein the cutter 20 is lifted from the cutting material 200 enables the cutter 20 to be separated more reliably from the cutting material 200 despite the presence of a frictional force between the cutter 20 and the cutting material 200.

In some embodiments, the time interval during which the state wherein the cutter 20 is lifted from the cutting material 200 can be, for example, 10 ms or more. This time is not limited thereto, but can be, for example, 20 ms or more. In other embodiments, this time can be set to 50 ms or more. Note that the time interval during which the cutter 20 is lifted from the cutting material 200 is maintained can be set to a time that can sufficiently reliably separate the cutter 20 from the cutting material 200. The longer the time interval during which the state wherein the cutter 20 is lifted from the cutting material 200 is maintained, the longer the cycle time for cutting the cutting material 200. Because of this, the time interval during which the state wherein the cutter 20 is lifted from the cutting material 200 is maintained need not be set to a time that is longer than necessary.

The time interval during which the state wherein the cutter 20 is lifted from the cutting material 200 is maintained can be set to an appropriate time determined by carrying out testing in advance. Moreover, the configuration may be such that the time interval that is set in advance in the second step can be set by a user. The time interval during which the cutter 20 is lifted from the cutting material 200 is maintained may differ depending on the frictional force that acts between the cutter 20 and the cutting material 200. The separation of the cutter 20 from the cutting material 200 can be set more reliably through the time being set appropriately by the user.

Although not shown in the drawings, the cutting machine 100 can be provided with a detecting portion for detecting whether or not the cutter 20 has been separated from the cutting material 200. This detecting portion can comprise a distance measuring sensor provided on the cutter carriage 30, configured to measure the distance between the cutter carriage 30 and the cutting material 200. As such, the output of the sensor can used as an indication of whether or not the cutting material 200 has been pulled up together with the cutter 20. Moreover, the cutting material 200 being pulled up together with the cutter 20 may be detected instead based on an image captured by a camera that can be provided on the cutter carriage 30. Whether or not the cutter 20 has been separated from the cutting material 200 can instead be detected by detecting the reaction force received from the shaft 21 of the cutter 20 in the holding portion 31 that holds the shaft 21 of the cutter 20.

In some embodiments, the third processing portion 73 is structured so as to execute a third step. The third step can be a step wherein the blade of the cutter 20 is brought into contact with the cutting material 200 with a force that has been set in advance so that the cutting material 200 will not be cut, and is caused to face along the other cutting line of the corner portion Sc, following the second step. Because contact between the cutter 20 and the cutting material 200 was temporarily suspended in the second step, in the third step the blade 22 of the cutter 20 can be directed along the other cutting line of the corner portion Sc smoothly.

The fourth processing portion 74 can be structured so as to execute a fourth step. The fourth step can be a step for causing the blade 22 of the cutter 20 to press against the cutting material 200 with a force that has been set in advance, and moving along the other cutting line of the corner portion Sc so that the cutting material 200 will be cut at at least a portion of the other cutting line of the corner portion Sc, after the third step. In the fourth step, the cutting material 200 can be cut along the other cutting line of the corner portion Sc by the blade 22 of the cutter 20.

In some embodiments, the tip end 22*a* of the blade 22 is offset from the shaft 21, as depicted in FIG. 2. Additionally, the cutter 20 can be operated in a state wherein the shaft 21 is supported so as to enable rotation. A cutting operation using the blade 22 of the cutter 20 to cut the cutting material 200 along a corner portion Sc2 (referencing FIG. 6) wherein the cutting line S1 bends at a right angle from one cutting line Sc21 toward the other cutting line Sc22, is explained below, as an example.

Figure 7:
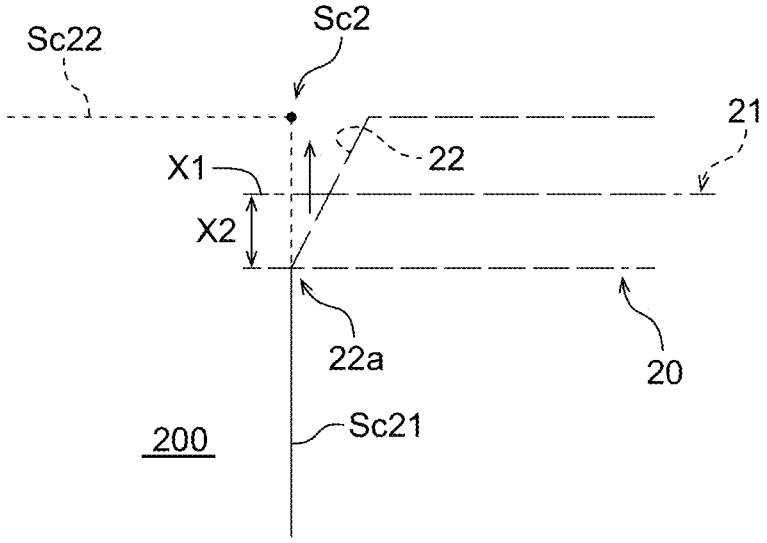
FIG. 7 is a schematic diagram depicting a step (first step) for cutting the cutting material 200 along one cutting line Sc21 that ends at a corner portion Sc2.
Figure 8:
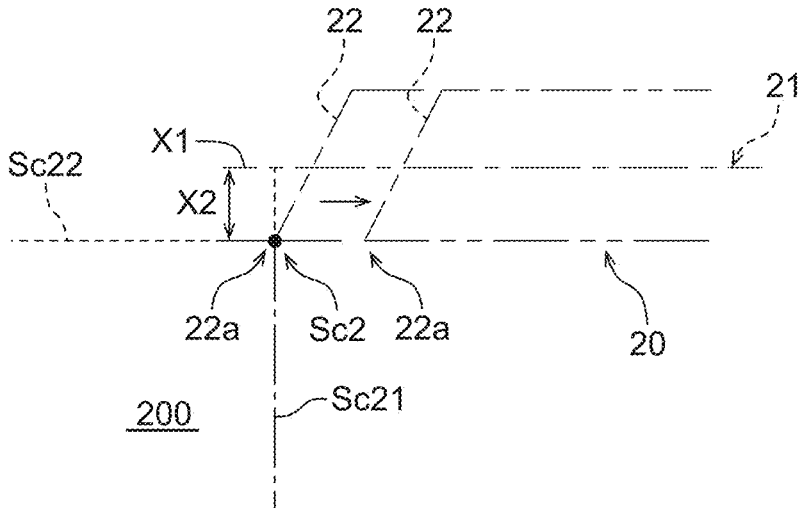
FIG. 8 is a schematic diagram depicting a step (second step) for lifting a tip end 22*a* of a blade 22 of the cutter 20 from the cutting material 200.
Figure 9:
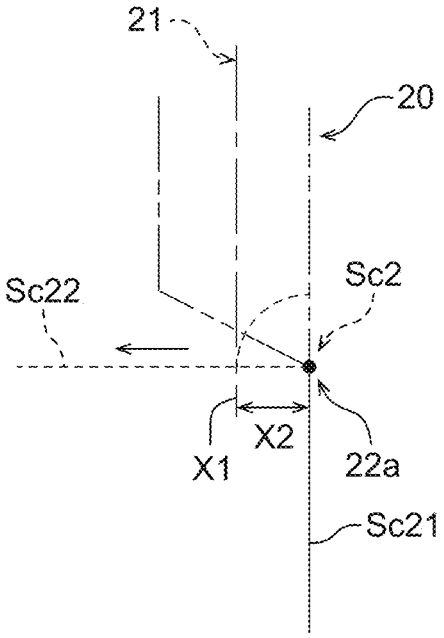
FIG. 9 is a schematic diagram depicting a step (third step) for causing the blade of the cutter 20 to contact the cutting material 200, facing the other cutting line Sc22 of the corner portion Sc2.

FIG. 7 is a schematic diagram depicting a step (first step) for cutting the cutting material 200 along one cutting line Sc21 that arrives at the corner portion Sc2. FIG. 8 is a schematic diagram depicting a step (second step) for lifting the tip end 22*a* of the blade 22 of the cutter 20 up from the cutting material 200. FIG. 9 is a schematic diagram depicting a step (third step) for causing the blade of the cutter 20 to come into contact with the cutting material 200, and to face the other cutting line of the corner portion Sc2.

Note that the cutter 20 is actually in a state wherein the shaft 21 of the cutter 20 is perpendicular to the cutting line Sc21, erect in respect to the cutting material 200. For convenience in explanation, FIG. 7 through FIG. 9 show, with virtual lines, a state wherein the cutter 20 is laying over the cutting material 200 so that the shaft 21 of the cutter 20 will be perpendicular to the cutting line Sc21.

As depicted in FIG. 7, when the cutting material 200 is cut along the cutting line Sc21, the blade 22 of the cutter 20 is moved, in the first step, along one cutting line Sc21 that arrives at the corner portion Sc2. At this time, the tip end 22*a* of the blade 22 of the cutter 20 will be positioned to the rear of the shaft 21 of the cutter 20, in terms of the direction of forward motion of the blade 22. The tip end 22*a* of the blade 22 of the cutter 20 is pressed against the cutting material 200 with a force that is set in advance so that the cutting material 200 will be cut.

The first step ends when the tip end 22*a* of the blade 22 of the cutter 20 has arrived at the corner portion Sc2, as depicted in FIG. 8. At this time, the centerline X1 of the shaft 21 of the cutter 20 has moved beyond the cutting line Sc22, by the offset distance X2 of the blade 22 of the cutter 20, along the cutting line Sc21. In the present embodiment, as depicted in FIG. 8, in the second step, in this position the tip end 22*a* of the blade 22 of the cutter 20 is lifted from the cutting material 200.

Following this, in the third step, the blade of the cutter 20 is caused to contact the cutting material 200 with a force that is set in advance so that the cutting material 200 will not be cut.

At this time, as depicted in FIG. 8, the centerline X1 of the shaft 21 of the cutter 20 has overshot, by the offset distance X2 of the blade 22 of the cutter 20, along the cutting line Sc21. At this position, the blade of the cutter 20 is caused to contact the cutting material 200, from the state wherein the tip end 22*a* of the blade 22 of the cutter 20 had been lifted from the cutting material 200. The force with which the tip end 22*a* of the blade 22 of the cutter 20 contacts the cutting material 200 is a force that is set in advance so that the cutting material 200 will not be cut.

Following this, in the third step, the blade 22 of the cutter 20 is caused to face the other cutting line Sc22 of the corner portion Sc2 in a state where, in this way, the tip end 22*a* of the blade 22 of the cutter 20 is in contact with the cutting material 200. In this embodiment, as depicted in FIG. 9, the centerline X1 of the shaft 21 of the cutter 20 is moved so as to describe an arc, while the tip end 22*a* of the blade 22 remains over the corner portion Sc2, in accordance with the offset distance X2 of the blade 22 of the cutter 20. Through this, the centerline X1 of the shaft 21 of the cutter 20 is moved to a position that is advanced, from the corner portion Sc2, along the cutting line Sc22 by the offset distance X2 of the blade 22 of the cutter 20. At this time, the blade 22 of the cutter 20 faces the other cutting line Sc22 of the corner portion Sc2. Thereafter, in the fourth step, the blade 22 of the cutter 20 can be pressed against the cutting material 200 with a force that is set in advance so that the cutting material 200 will be cut, and then moved along the other cutting line of the corner portion Sc2.

In this way, given the cut processing portion 70, in the first step, the blade 22 of the cutter 20 is pressed against the cutting material 200 with a force that is set in advance so that the cutting material 200 will be cut, and moved along one cutting line Sc21 that arrives at the corner portion Sc2. Through the second step, the blade 22 of the cutter 20 is lifted from the cutting material 200, to be separated from the cutting material 200, causing the shaft 21 of the cutter 20 to be free. Thereafter, in the third step, the blade 22 of the cutter 20 is caused to contact the cutting material 200 with a force that is set in advance so that the cutting material 200 will not be cut. Following this, the blade of the cutter 20 is caused to face the other cutting line Sc22 of the corner portion Sc2. Through the second step and the third step, the blade 22 is faced smoothly in the direction along the other cutting line Sc22 of the corner portion Sc2. The fourth step is executed thereafter. In the fourth step, the blade 22 of the cutter 20 is pressed against the cutting material 200 with a force that is set in advance so that the cutting material 200 will be cut, and moved along the other cutting line Sc22 of the corner portion Sc2. As a result, the corner portion Sc2 of the cutting material 200 will be cut cleanly along the cutting lines Sc21 and Sc22.

Here the first step and the fourth step may be structured so that die cuts and half cuts are repeated sequentially.

Here a "die cut" is a process wherein the blade 22 of the cutter 20 is caused to contact the cutting material 200 with a force that is set in advance so that the cutting material 200 will be cut fully through the thickness of the material 200 or through only a predetermined number of distinct layers of the sheet material, for example, cuts that define intended contours of the edges of one, a plurality, or all of the layers of the sheet material 200. A "half cut" or "superficial cut" is a process wherein the blade of the cutter 20 is caused to contact the outer surface of the cutting material 200 with a force that is set in advance so that the cutting material 200 will not be cut completely through the full thickness of the material 200 or any layer of the material 200, thereby either not cutting at all or only superficially cutting the outer surface of the material 200. That is, in a "die cut" the cutting material 200 is cut. In contrast, the cutting material 200 is not cut in a "half cut."

Repeating die cuts and half cuts will result in perforations wherein locations that are cut completely though the thickness of one or more layers the material 200 and locations that are not cut completely through the thickness of any layer of the material 200 will be produced alternatingly. In this way, the first step and the fourth step may be configured so that perforations are formed in the cutting material 200 along the cutting line. That is, when the cutting lines S1 through S5 form a closed region, as depicted in FIG. 6, if the cutting material 200 were cut completely along the cutting lines S1 through S5, then the cutting material 200 would shift at the positions that were cut completely. With perforations, on the other hand, some portions will be connected, enabling cutting of the cutting material 200 all the way to the end, even in the closed regions. The positions that are connected in the perforations should be set to lengths that can be torn or cut easily, after cutting, through, for example, pulling on the cut material 200 or pressing lightly with a cutter.

Note that in the perforations, the places wherein the cutting material 200 is not cut, through the half cuts, should be set so as to be adequately short when compared to the places wherein the cutting material 200 is cut by the die cuts. For example, the lengths of the places that are not cut, through the half cuts (the half cut lengths) may be about 1/10, or more preferably, 1/50, or even more preferably 1/100 the lengths of the places in the cutting material 200 that are cut through die cuts (die cut length). For example, if the die cut length is 50 mm, the half cut length may be 0.5 mm. The configuration may be such that the user is able to set appropriate lengths for the die cut length and the half cut length.

Here the first storing portion 50*b*1 of the controlling device 50 (referencing FIG. 5) stores the force that is set in advance so that the cutting material 200 will be cut. The force that is set in advance so that the cutting material 200 will be cut may be, for example, stored in advance in the first storing portion 50*b*1. A plurality of forces, set in advance so that the cutting material 200 will be cut, depending on the cutting material 200, the cutter 20, and conditions such as the temperature, may be stored in the first storing portion 50*b*1 in advance. Moreover, the configuration may be such that the force that is set in advance so that the cutting material 200 will be cut may be set as appropriate by a user depending on the cutting material 200, the cutter 20, and conditions such as the temperature. Note that the force that is set in advance so that the cutting material 200 will be cut may be termed the "die-cut pressure" arbitrarily.

Moreover, the second storing portion 50*b*2 stores a force that is set in advance so that the cutting material 200 will not be cut. The force that is set in advance so that the cutting material 200 will not be cut may be, for example, stored in advance in the second storing portion 50*b*2. A plurality of forces, set in advance so that the cutting material 200 will not be cut, depending on the cutting material 200, the cutter 20, and conditions such as the temperature, may be stored in the second storing portion 50*b*2 in advance. Moreover, the configuration may be such that the force that is set in advance so that the cutting material 200 will not be cut may be set as appropriate by a user depending on the cutting material 200, the cutter 20, and conditions such as the temperature. Note that the force that is set in advance so that the cutting material 200 will not be cut may be termed the "half-cut pressure" arbitrarily.

Additionally, the force that is set in advance so that the cutting material 200 will be cut may be determined depending on the cutting material 200. For example, the cutting material 200 may be a backing sheet with a seal affixed thereto. In this case, a first force that is set so as to cut only the seal that is affixed to the backing sheet, and a second force that is set so as to cut, for the individual backing sheet, the backing sheet to which the seal is affixed, may be set as respective forces that are set in advance so that the cutting material 200 will be cut. The first force and the second force may be selected as appropriate following a program that is established in advance. This enables the seal to be cut alone, or to be cut together with the backing sheet. In this case as well, when there is at least one corner portion Sc1, Sc2 wherein the cutting line S1 changes direction, the second step, for lifting the blade of the cutter 20 from the cutting material 200, should be performed at the corner portion Sc1, Sc2. In this way, the force that is set in advance so that the cutting material 200 will be cut may be set with a plurality of forces. This enables cutting the cutting material 200 appropriately, depending on a variety of cutting materials 200.

The steps performed by the cut processing portion 70 are explained below.

With continued reference to FIG. 6, the cutting line S1 that encompasses the rectangular region A1, and the cutting lines S2 through S5 that encompass the triangular regions A2 through A5, each has a plurality of corner portions Sc wherein the cutting lines S1 through S5 change direction. In this embodiment, the controlling device 50 has a second setting portion 50*a*2, as depicted in FIG. 5.

Figure 10:
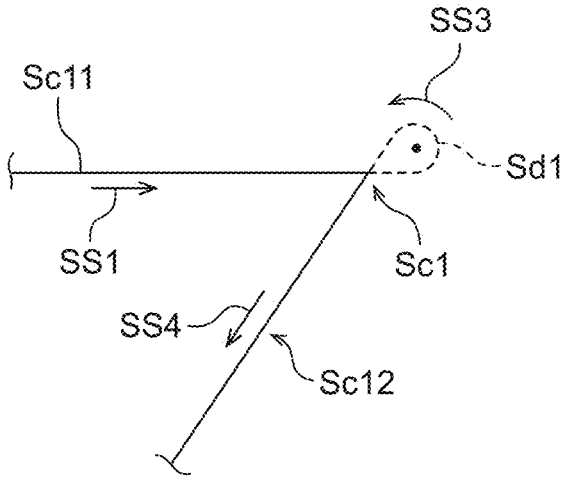
FIG. 10 is a schematic diagram depicting an example of a blade turning path Sd1 that is set at the corner portion Sc1, in the corner portion Sc depicted in FIG. 6.

FIG. 10 is a schematic diagram depicting an example of a blade turning path Sd1 that is set at the corner portion Sc1 of the corner portion Sc depicted in FIG. 6. Here, in FIG. 10, the arrow SS1 indicates the direction of movement of the blade 22 of the cutter 20 in the first step, described below. The arrow SS3 indicates the direction of movement of the blade 22 of the cutter 20 in the third step. The arrow SS4 shows the direction of movement of the blade 22 of the cutter 20 in the fourth step. The same is true for the arrows SS1, SS3, and SS4 in FIG. 11 through FIG. 13, described below.

The second setting portion 50*a*2, as depicted in FIG. 10, is programmed so that when there is one or more corner portions Sc1 wherein there is a change in direction of a cutting line S1, one cutting line Sc11, and another cutting line Sc12, which intersect at the corner portion Sc1, and a blade turning path Sd1, made from a curve connecting these cutting lines, will be set in the vicinity of the corner portion Sc1. The second setting portion 50*a*2 should be programmed in advance so as to set the blade turning path Sd1, made from an appropriate curve, depending on the angle of change between the one cutting line Sc11 and the other cutting line Sc12 that intersect at the corner portion Sc1, for example. Here the blade turning path Sd1 should be a curve that is appropriate for changing the direction of the blade 22 of the cutter 20.

The configuration can be such that, after the second step, when the blade turning path Sd1 is set in this way, then in the third step by the cut processing portion 70, the blade 20 of the cutter is caused to contact the cutting material 200 with a force that has been set in advance so that the cutting material 200 will not be cut, and is moved so as to arrive at the other cutting line Sc12 of the corner portion Sc1 following the blade turning path Sd1.

In the example depicted in FIG. 10, the blade turning path Sd1 is depicted by a dotted line. In the form depicted in FIG. 10, the blade turning path Sd1 describes an arc that connects one cutting line Sc11 and the other cutting line Sc12 of a corner portion Sc1, in the respective tangent line directions thereof. The radius of curvature of the arc of the blade turning path Sd1 should be set to a radius so that the tip end 22*a* of the blade 22 of the cutter 20 will follow smoothly in the blade turning process, following the blade turning path Sd1.

Note that the blade turning path Sd1 should be a path such that the tip end 22*a* of the blade 22 of the cutter 20 follows smoothly in the blade turning process, to change the direction from the one cutting line Sc11 to the other cutting line Sc12 of the corner portion Sc1. From this perspective, the blade turning path Sd1 should be set to a curve that connects smoothly the one cutting line Sc11 and the other cutting line Sc12 of the corner portion Sc1. The blade turning path Sd1 is not limited to the shape depicted in FIG. 10.

In this embodiment, the first processing portion 71 is structured so as to execute the first step for pressing the blade 22 of the cutter 20 against the cutting material 200 with the force that has been set in advance so that the cutting material 200 will be cut, and moving the blade 22 of the cutter 20 along the one cutting line Sc11 that arrives at the corner portion Sc1.

The second processing portion 72 is structured so as to execute the second step for lifting the tip end 22*a* of the blade 22 of the cutter 20 from the cutting material 200 after the first step.

In this second step, the tip end 22*a* of the blade 22 of the cutter 20 should be lifted away from the cutting material 200, that is, the tip end 22*a* of the blade 22 of the cutter 20 should be separated from the cutting material 200. Through separating the cutter 20 from the cutting material 200, the contact between the cutter 20 and the cutting material 200 is removed temporarily. When the contact between the cutter 20 and the cutting material 200 is eliminated temporarily, the shaft 21 of the cutter 20 becomes free to rotate within the holding portion 31.

The third processing portion 73 is structured so as to execute a third step wherein, following the second step, the blade 22 of the cutter 20 is brought into contact with the cutting material 200 with a force that has been set in advance so that the cutting material 200 will not be cut, and is caused to move along the blade turning path Sd1, to arrive at the other cutting line of the corner portion Sc1. After contact between the cutter 20 and the cutting material 200 temporarily removed in the second step, the blade 22 of the cutter 20 is directed along the path Sd1 smoothly when entering into the blade turning path Sd1 in the third step.

The fourth processing portion 74 is structured so as to execute, after the third step, a fourth step wherein the blade 22 of the cutter 20 is brought into contact with the cutting material 200 with a force that has been set in advance so that the cutting material 200 will be cut, and is moved along the other line of the corner portion Sc1.

In the fourth step, the cutting material 200 can be cut along the other cutting line of the corner portion Sc1 by the blade 22 of the cutter 20.

In this way, when the cutting line S1 has at least one corner portion Sc1 wherein the direction changes, the blade turning path Sd1 that is made from a curve that connects together the one cutting line Sc11 and the other cutting line Sc12, which intersect at the corner portion Sc1, set in the vicinity of the corner portion Sc1. Additionally, after the first step, the configuration should be such that, in the second step, the tip end 22*a* of the blade 22 of the cutter 20 is lifted away from the cutting material 200. Additionally, the configuration should be such that, in the third step, the blade of the cutter 20 is caused to contact the cutting material 200 with a force that is set in advance so that the cutting material 200 will not be cut, and such that the blade of the cutter 20 will follow the blade turning path Sd1 to arrive at the other cutting line Sc12 of the corner portion Sc1.

Through this, the direction of the blade 22 of the cutter 20 will change smoothly, at the corner portion Sc1, from the direction of the one cutting line Sc11 to the direction of the other cutting line Sc12. Note that there may be programming in advance so that the blade turning path Sd1 will be set as appropriate depending on conditions that are determined in advance, such as the angle of the corner portion Sc1. Consequently, the direction of the blade may be changed without setting the blade turning path as the path for the tip end 22*a* of the blade 22 of the cutter 20 depicted in FIG. 7 through FIG. 9. However, in the mode of operation depicted in FIG. 10, the direction of the blade may instead be changed by setting the blade turning path Sd1 as the path for the tip end 22*a* of the blade 22 of the cutter 20.

FIG. 11 through FIG. 14 is each a schematic diagram depicting an example of cutting of the corner portion Sc1. In the modes depicted in FIG. 11 through FIG. 14, perforations are formed along one of the cutting lines Sc11 of the corner portion Sc1, and perforations are also formed along the other cutting line Sc12 of the corner portion Sc1.

Figure 11:
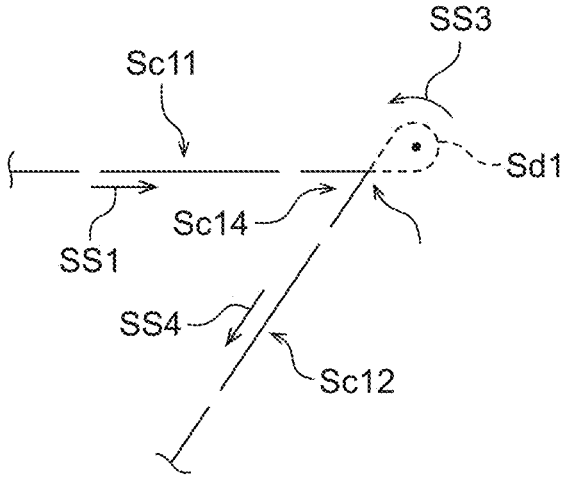
FIG. 11 is a schematic diagram depicting an example of cutting of the corner portion Sc1.

In the mode depicted in FIG. 11, the configuration is such that, in the first step, the front part that arrives at the corner portion Sc1 along the one cutting line Sc11 is processed through a die cut. Additionally, the configuration is such that, in the fourth step, the process begins with a half cut from the corner portion Sc1 along the other cutting line Sc12. That is, perforations are formed along the one cutting line Sc11 of the corner portion Sc1 through the first step so that there will be die-cut pressure at the point of intersection at the corner portion Sc1. Thereafter, at the point of intersection of the corner portion Sc1, the blade 22 is lifted up through the second step.

Following this, the blade 22 is moved, with a half-cut pressure, along the blade turning path Sd1 in the third step, moving the blade so as to arrive at the other cutting line Sc12 of the corner portion Sc1. Through this, the blade 22 will be in the direction of the other cutting line Sc12. Moreover, in the fourth step, perforations are first formed, with the half-cut pressure, along the other cutting line Sc12 from the point of intersection at the corner portion Sc1. Through this, perforations are cut with a part Sc14, along the other cutting line Sc12 from the point of intersection at the corner portion Sc1, connected, as depicted in FIG. 11. In this case, the structure should be such that the length of the part Sc14 that is connected, from the point of intersection at the corner portion Sc1, can be set as appropriate by the user.

Figure 12:
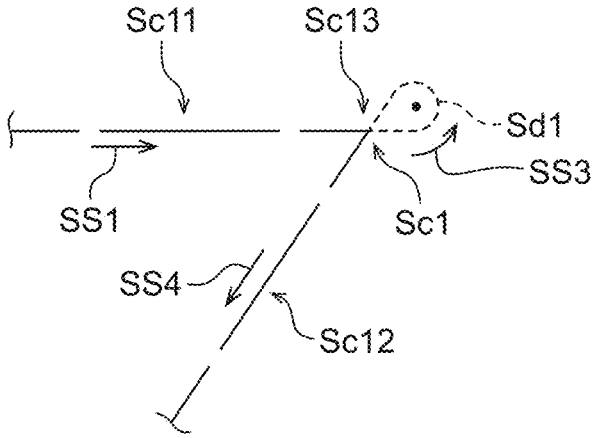
FIG. 12 is a schematic diagram depicting an example of cutting up the corner portion Sc1.

In the mode depicted in FIG. 12, the configuration is such that, in the first step, the front part that arrives at the corner portion Sc1 along the one cutting line Sc11 is processed through a half cut. Additionally, the configuration is such that, in the fourth step, the process begins with a die cut from the corner portion Sc1 along the other cutting line Sc12. That is, perforations are formed along the one cutting line Sc11 of the corner portion Sc1 through the first step so that there will be half cut pressure at the point of intersection at the corner portion Sc1. Thereafter, at the point of intersection of the corner portion Sc1, the blade 22 is lifted up through the second step.

Following this, the blade is moved, with a half-cut pressure, along the blade turning path Sd1 in the third step, moving the blade so as to arrive at the other cutting line Sc12 of the corner portion Sc1. Through this, the blade 22 will be in the direction of the other cutting line Sc12. Moreover, in the fourth step, perforations are first formed, with the die-cut pressure, along the other cutting line Sc12 from the point of intersection at the corner portion Sc1. Through this, perforations are cut with a part Sc13, along the one cutting line Sc11 from the point of intersection at the corner portion Sc1, connected, as depicted in FIG. 12. In this case, the structure should be such that the length of the part Sc13 that is connected, from the point of intersection at the corner portion Sc1, can be set as appropriate by the user.

In the mode wherein cutting is as in FIG. 11 and FIG. 12, the cutting material 200 is cut with the die-cut pressure at the point of intersection at the corner portion Sc1 at the one cutting line Sc11 or the other cutting line Sc12. In contrast, the one cutting line that is not die-cut up to the point of intersection at the corner portion Sc1, the cutting material 200 is processed with the half-cut pressure up to a distance that has been set in advance from the point of intersection at the corner portion Sc1. That is, while in FIG. 11 the one cutting line Sc11 is die-cut up to the point of intersection at the corner portion Sc1, there is no cut on the other cutting line Sc12 up to the distance that has been set in advance from the point of intersection at the corner portion Sc1, with the connected part Sc14 left in a connected state. By contrast, in the mode depicted in FIG. 12, the one cutting line Sc12 is die-cut up to the point of intersection at the corner portion Sc1, there is no cut on the other cutting line Sc11 up to the distance that has been set in advance from the point of intersection at the corner portion Sc1, with the connected part Sc13 left in a connected state. Because of this, the corner portion Sc1 of the cutting material 200 does not shift during processing by the cut processing portion 70. Note that, additionally, the turn at the corner portion Sc1 of the cutting material 200 is cut cleanly. In particular, when the cutting material 200 is pulled apart, the turn at the corner portion Sc1 of the cutting material 200 tends to be pulled apart cleanly. In this case, the configuration may be such that the length of the parts Sc13 and Sc14 that are connected, from the point of intersection at the corner portion Sc1, can be set as appropriate by the user.

In the mode depicted in FIG. 13, the configuration is such that, in the first step, the front part that arrives at the corner portion Sc1 along the one cutting line Sc11 is processed through a half cut. Additionally, the configuration is such that, in the fourth step, the process begins with a half cut from the corner portion Sc1 along the other cutting line Sc12. That is, perforations are formed along the one cutting line Sc11 of the corner portion Sc1 through the first step so that there will be half cut pressure at the point of intersection at the corner portion Sc1. Thereafter, at the point of intersection of the corner portion Sc1, the blade 22 is lifted up through the second step.

Following this, the blade is moved, with a half-cut pressure, along the blade turning path Sd1 in the third step, moving the blade so as to arrive at the other cutting line Sc12 of the corner portion Sc1. Through this, the blade 22 will be in the direction of the other cutting line Sc12. Moreover, in the fourth step, perforations are first formed, with the half-cut pressure, along the other cutting line Sc12 from the point of intersection at the corner portion Sc1. Through this, perforations are cut with parts Sc13 and Sc14, along both the cutting lines Sc11 and Sc12 from the point of intersection with the corner portion Sc1, connected, as depicted in FIG. 12. In this case, the corner portion Sc1 of the cutting material 200 will not shift during processing by the cut processing portion 70. In this case, the configuration should be such that the lengths of the part Sc13 that is connected, from the point of intersection of the corner portion Sc1, and of the part Sc14 that is connected, from the point of intersection of the corner portion of the Sc1, are each set as appropriate by the user.

In the mode depicted in FIG. 14, the configuration is such that, in the first step, the front part that arrives at the corner portion Sc1 along the one cutting line Sc11 is processed through a die cut. Additionally, the configuration is such that, in the fourth step, the process begins with a die cut from the corner portion Sc1 along the other cutting line Sc12. That is, perforations are formed along the one cutting line Sc11 of the corner portion Sc1 through the first step so that there will be die cut pressure at the point of intersection at the corner portion Sc1. Thereafter, at the point of intersection of the corner portion Sc1, the blade 22 is lifted up through the second step.

Following this, the blade is moved, with a half-cut pressure, along the blade turning path Sd1 in the third step, moving the blade so as to arrive at the other cutting line Sc12 of the corner portion Sc1. Through this, the blade 22 will be in the direction of the other cutting line Sc12. Moreover, in the fourth step, perforations are first formed, with the die-cut pressure, along the other cutting line Sc12 from the point of intersection at the corner portion Sc1. Through this, as depicted in FIG. 14, perforations are cut in a mode wherein the corner portion Sc1 of the cutting material 200 is cut with the respective die-cut pressures along the one cutting line Sc11 and the other cutting line Sc12, and wherein portions are connected along the one cutting line Sc11 and the other cutting line Sc12.

In this case, the corner portion Sc1 of the cutting material 200 is cut, so the corner portion Sc1 will tend to be cut apart cleanly. Note that the shorter the distance to the place that is connected by the half-cut pressure from the point of intersection at the corner portion Sc1 that is set, the less the likelihood of the corner portion Sc1 of the cutting material 200 will shift during processing by the cut processing portion 70. In this case, the configuration may be one wherein the distance on the one cutting line Sc11 from the point of intersection at the corner portion Sc1 to the place Sc15 that is connected with the half-cut pressure, and the distance on the other cutting line Sc12 from the point of intersection at the corner portion Sc1 to the place Sc16 that is connected with the half-cut pressure are each set as appropriate by the user.

Note that while here an example is presented as a cutting machine 100, the cutting machine 100 that is disclosed here may be applied appropriately to a printer. In this case, the cutting material 200 may be any of a variety of types of media that are printed by the printer.

FIG. 15 is a schematic diagram depicting a pattern for positioning of the blade 22 when the cutting material 200 is a medium wherein a seal is affixed on a backing sheet. When the cutting material 200 is a medium (printed medium) wherein a seal 202 is affixed onto a backing sheet 201, for example, a first die-cut pressure and a second die-cut pressure can be set as the die-cut pressure. Here the first die-cut pressure can be set to a force that is set in advance so that the backing sheet 201 and the seal 202 are cut, as depicted in (a). The second die-cut pressure can be set to a force that is set in advance so that only the seal 202 on the backing sheet 201 will be cut, as depicted in (b). Moreover, the half-cut pressure can be set as a force that is set in advance so that the seal 202 on the backing sheet 201 will not be cut, as depicted in (c).

This enables achievement of perforation cutting wherein only the seal is cut, and perforation cutting wherein the backing sheet 201 and the seal 202 are cut, and, through combining the processes for the cut processing portion 70, described above, even when a corner portion exists in a cutting line that has been set, the corner portion can be processed cleanly.

When a cutting machine 100 is incorporated into a printer in this way, the platen upon which the medium is placed in the printer may be used as the supporting platform 10 for the cutting machine 100. The cutter carriage 30 may be installed on the carriage for moving the printer head. This enables the moving mechanism that moves the carriage of the printer head in respect to the media to be used as the moving mechanism 40 for the cutting machine 100.

The printer into which the cutting machine 100 is incorporated, as described above, is able to form perforations along the cutting lines. The medium is not cut completely through the perforations. Because of this, the printing may be carried out on the medium after formation of the perforations along the cutting lines of the medium made in advance, through the functions of the cutting machine 100. Moreover, instead the perforations may be formed along the cutting lines that have been set for the medium, or the medium may be cut at prescribed positions, through the functions of the cutting machine 100 after printing has been performed on the medium.

The cutting material 200 of the cutting machine 100 may be include a seal with a backing sheet. In order to handle such a case, a plurality of different forces may be set in advance in the controlling device 50 of the cutting machine 100, for cutting of the cutting material 200.

As described above, in the cutting machine 100 or printer that is disclosed here, the controlling device 50 may be configured so as to execute the following steps (a) through (c), for example, in the process for cutting a corner portion. Additionally, the disclosure here, as another aspect thereof, may be a program for causing the controlling device of the cutting machine 100 or the printer to execute the steps of (a) through (c), below. Furthermore, this program may be recorded on a non-transitory computer readable medium. The explanation here will be based on the drawings presented in FIG. 11 and FIG. 12.

Steps (a) through (c) (referencing FIG. 11):

(a) Cutting lines S1 through S5 are set (referencing FIG. 6) for a cutting material 200 that is placed on a supporting platform 10 (referencing FIG. 1);

(b) For one cutting line Sc12, of a first cutting line Sc11 and a second cutting line Sc12 that create a corner portion Sc1 wherein there is a change of direction in a cutting line S1 through S5, a part Sc14 is left connected, without the cutting material 200 being cut, for a distance that is set in advance from the point of intersection of the corner portion Sc1, and the cutting material 200 is cut along the one cutting line Sc12, except for the connected part Sc14;

(c) On the other cutting line Sc11, the cutting material 200 is cut so as to not leave a part that is connected, up to a distance that has been set in advance from the point of intersection of the corner portion Sc1.

Moreover, as depicted in FIG. 12, the step in (b) and the step in (c) may be the following steps.

Steps for (b) through (c):

(b) For one cutting line Sc11, of a first cutting line Sc11 and a second cutting line Sc12, a part Sc13 is left connected, without the cutting material 200 being cut, for a distance that is set in advance from the point of intersection of the corner portion Sc1, and the cutting material 200 is cut along the one cutting line Sc11, except for the connected part Sc13;

(c) On the other cutting line Sc12, the cutting material 200 is cut so as to not leave a part that is connected, up to a distance that has been set in advance from the point of intersection of the corner portion Sc1.

Given this cutting machine, for one cutting line, of a first cutting line Sc11 and a second cutting line Sc12 that form a corner portion Sc1, a part Sc13 is left connected, without the cutting material being cut, for a distance that is set in advance from the point of intersection of the corner portion. From this point of view, there is no particular limitation on how the cutting material 200 controls the sequence or blade for cutting the cutting line.

Figure 16A:
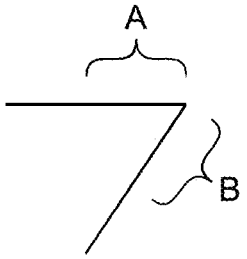
FIG. 16A is a diagram depicting a mode of cutting when cutting the cutting material along a cutting line that has a corner portion.
Figure 16B:
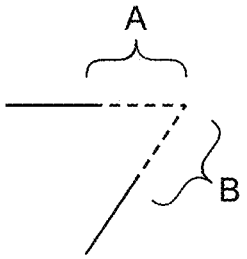
FIG. 16B is a diagram depicting another mode of cutting when cutting the cutting material along a cutting line that has a corner portion.
Figure 16C:
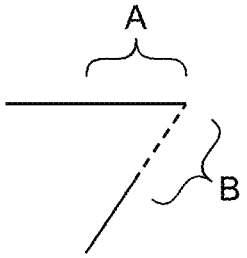
FIG. 16C is a diagram depicting yet another mode of cutting when cutting the cutting material along a cutting line that has a corner portion.

FIG. 16A through FIG. 16C are diagrams depicting cutting modes when cutting the cutting material along a cutting line that has a corner portion.

In FIG. 16A, both the part A of a prescribed distance from the point of intersection of the corner portion on one cutting line and the part B of a prescribed distance from the point of intersection of the corner portion on the other cutting line are cut, i.e., die-cut.

In FIG. 16B, part A, of a prescribed distance of one of the cutting lines from the point of intersection at the corner portion, and part B, of a prescribed distance from the point of intersection at the corner portion of the other of the cutting line are left remaining, without being cut. That is, part A, of a prescribed distance of one of the cutting lines from the point of intersection at the corner portion, and part B, of a prescribed distance from the point of intersection at the corner portion of the other of the cutting line, are each connected parts that are not cut.

In FIG. 16C, part A, of a prescribed distance of one of the cutting lines from the point of intersection at the corner portion, is cut, and part B, of a prescribed distance from the point of intersection at the corner portion of the other of the cutting line, is left remaining without being cut. That is, part B, of a prescribed distance from the point of intersection at the corner portion of the other of the cutting line, is a connected part that is not cut.

Figure 17A:
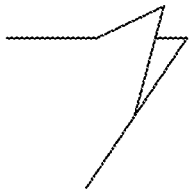
FIG. 17A is a diagram depicting the state wherein a corner portion the cutting material, cut in the mode of cutting depicted in FIG. 16A, is bent upward.

FIG. 17A is a diagram depicting the state wherein a corner portion the cutting material, cut in the mode of cutting depicted in FIG. 16A, is bent upward. In the mode in FIG. 16A, both sides of the corner portion of the cutting material are cut. As depicted in FIG. 17A, after cutting, the inside part of the corner portion of the cutting material may end up bent upwards. In the mode of cutting in FIG. 16B and FIG. 16C, the point of intersection at the corner portion is connected, rather than being cut, for a prescribed distance on one of the cutting lines, and thus the inside part of the corner portion of the cutting material does not bend upward.

Figure 17B:
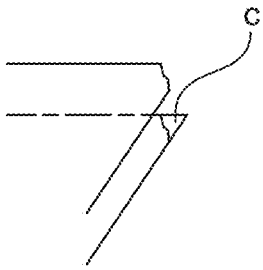
FIG. 17B is a diagram depicting the state wherein a tip of the corner portion of the cutting material, cut in the mode of cutting depicted in FIG. 16B, is torn.

FIG. 17B is a diagram depicting the state wherein a tip of the corner portion of the cutting material, cut in the mode of cutting depicted in FIG. 16B, is torn. In the mode of cutting depicted in 16B, both sides of the corner portion of the cutting material are connected, without having been cut. When the inside part of the corner portion of the cutting material is pulled apart after completion of cutting, the tip end part C of the inside part of the corner portion of the cutting material can end up torn, as depicted in FIG. 17B. In the mode of cutting depicted in FIG. 16B, cutting is not to the point of intersection of the corner portion for either the one cutting line or the other than form the inside part of the corner portion of the cutting material. The inside part of the corner portion of the cutting material is constrained in two different directions from the outside part (that is, the direction that is perpendicular to the cutting line part A and the direction that is perpendicular to the cutting line part B). Producing a cut part that has a corner portion (the inside part of the corner portion of the cutting material) that is lined up cleanly requires pulling apart carefully.

Figure 17C:
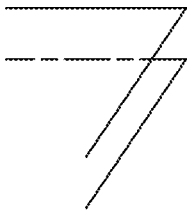
FIG. 17C is a diagram depicting the state wherein the corner portion of the cutting material, cut in the mode of cutting depicted in FIG. 16C, is pulled apart.

FIG. 17C is a diagram depicting the state wherein the corner portion of the cutting material, cut in the mode of cutting depicted in FIG. 16C, has been pulled apart cleanly. In the mode of cutting in FIG. 16C, one part, part A, of the corner portion of the cutting material has been cut, but the other part, part B, is connected, without having been cut. Because the other part, part B, of the corner portion is connected, there is little tendency for the inside part of the corner portion of the material that is cut to bend upward. The one part, part A, of the corner portion of the material that is cut is cut up to the point of intersection at the corner portion, and thus this part A can be pulled apart easily. Furthermore, when, after completion of cutting, pulling apart the inside part of the corner portion of the material that has been cut apart, it is pulled apart from the outside, starting with, for example, the inside part along the cutting line part A. The cutting line part B is then pulled apart from the outside part. Through this, a corner portion is produced that is lined up cleanly, without tearing the inside part of the corner portion of the material that has been cut. That is, in the mode of cutting in FIG. 16C, disclosed here, it is relatively easy to produce a cut material that has a corner portion (the inside part of the corner portion of the cut material) that is lined up cleanly, as depicted in FIG. 17C.

In step (b), a connected part is left, without the cutting material being cut, for a distance that is set in advance from the point of intersection with the corner on a cutting line that is either the first cutting line or the second cutting line that form the corner portion of the cutting material, and the cutting material is cut along the one cutting line, except for the connected part. In step (c), the cutting material is cut along the other cutting line so as to not leave a connected part up to a distance that has been determined in advance from the point of intersection of the corner. In these steps (b) and (c), there is no particular limitation in how the blade is moved, or the sequence in which the first cutting line and the second cutting line are cut, and these may be modified as appropriate.

While, in the above, various explanations have been made regarding one embodiment of the cutting machine that is disclosed here, the cutting machine that is disclosed here is not limited to the embodiment described above. Moreover, the cutting machine disclosed here may be modified in a variety of ways, insofar as no particular problems are produced, and the various structural elements and various steps referenced here may be omitted as appropriate or combined as appropriate.

What is claimed is:

1. A cutting machine, comprising:

a support platform;

a cutter having a shaft, and a blade that is formed on a tip end of the shaft;

a cutter carriage having a holding portion for holding the shaft of the cutter so as to enable rotation of the cutter;

a moving mechanism for moving the cutter carriage relative to the support platform; and a controlling device, wherein:

the controlling device is configured so that the following steps (a) through (c) are executed:

(a) setting a multi-part cutting line with respect to a cutting material that is placed on the support platform;

(b) cutting the cutting material along one cutting line, of a first cutting line and a second cutting line that form a corner portion wherein the multi-part cutting line changes direction, leaving a part that is connected, without the cutting material being cut, along a distance that is determined in advance from a point of intersection of the corner portion, and cutting the one cutting line except for the connected part;

(c) cutting, on an other cutting line of the first and second cutting lines, the cutting material so as to not leave a connected part, up to a distance that has been set in advance from the point of intersection of the corner portion;

wherein the controlling device comprises:

a first setting portion for setting a cutting line with respect to the cutting material that is placed on the support platform;

a second setting portion for setting, in the vicinity of the corner portion, a blade turning path made from a curve that connects continuously the one cutting line and the other cutting line that intersect at the corner portion; and a cut processing portion configured to execute the following:

a first step for pressing the blade of the cutter against the cutting material with a force that is set in advance so that the cutting material will be cut, in at least a portion of one cutting line that arrives at the corner portion in a case wherein the cutting line has at least one corner portion wherein the direction thereof changes, and for moving the blade of the cutter along the one cutting line to arrive at the corner portion;

a second step, following the first step, for lifting the blade of the cutter from the cutting material;

a third step, following the second step, for causing the blade of the cutter to contact the cutting material with a force that has been set in advance so that the cutting material will not be cut, and for directing the blade of the cutter to the other cutting line of the corner portion; and a fourth step, following the third step, for pressing the blade of the cutter against the cutting material with a force that is set in advance so that the cutting material will be cut, and for moving along the other cutting line of the corner portion, in at least a portion of the other cutting line of the corner portion;

wherein, in the first step, the cutting material is cut up to the point of intersection of the corner portion along the one cutting line; and wherein in the fourth step, a connected part is left, without the cutting material having been cut, for a distance that is established in advance from the point of intersection of the corner portion along the other cutting line, with the cutting material cut along the other cutting line thereafter.

2. A cutting machine as set forth in claim 1, wherein in the second step, the state wherein the blade of the cutter is lifted away from the cutting material is maintained for a time interval that is set in advance.

3. A cutting machine as set forth in claim 2, wherein the time interval during which the state wherein the blade of the cutter is lifted away from the cutting material is set to no less than 10 ms.

4. A cutting machine as set forth in claim 1, wherein the first storing portion is configured to store a force that is set in advance so that the cutting material will be cut, and the second storing portion is configured to store a force that is set in advance so that the cutting material will not be cut.

5. A cutting machine as set forth in claim 1, wherein:

the cutter carriage comprises a solenoid; and the solenoid is configured so as to support the holding portion, and so as to raise and lower the holding portion relative to the support platform.

6. A cutting machine as set forth in claim 1, wherein:

a plurality of forces are set in advance such that the cutting material will be cut.

7. A printer having a cutting machine as set forth in claim 1.

8. A printer as set forth in claim 7, comprising:

a printer head;

a carriage for holding the printer head; and a moving mechanism for moving the carriage in respect to the support platform, wherein:

the cutter carriage is incorporated into the carriage for holding the printer head.

9. A cutting machine, comprising:

a support platform;

a cutter member having a shaft and a blade disposed on an end of the shaft;

a cutter carriage comprising a holder configured to hold the shaft of the cutter member, the holder configured to allow rotation of the cutter member;

a moving mechanism configured to move the cutter carriage relative to the support platform; and a controller comprising one or more processors in communication with one or more storing devices and configured to execute the following processes (a) through (c):

(a) setting a multi-part cutting line with respect to a cutting material placed on the support platform, the multi-part cutting line comprising at least a first cutting line and a second cutting line that form a corner portion where the multi-part cutting line changes direction and the first and second cutting lines define a point of intersection;

(b) cutting the cutting material along one cutting line of the first and second cutting lines and leaving a part of the cutting material on the one cutting line connected thereby leaving a connected portion along the one cutting line over which the cutting material is not fully cut, the connected portion disposed at a first predetermined distance from the point of intersection of the corner portion;

(c) cutting the cutting material along an other cutting line of the first and second cutting lines without leaving any connected parts of the cutting material along a second predetermined distance from the point of intersection of the corner portion;

wherein the controller comprises:

a first setting portion configured to perform the step of setting a multi-part cutting line;

a second setting portion configured to store a blade turning path comprising a curve that connects continuously the end of the first cutting line with the end of the second cutting line; and a cut processing portion configured to execute the following:

a first step of pressing the blade of the cutter member against the cutting material with a first predetermined force sufficient to cut the cutting material, and moving the blade so as to cut the cutting material with the first predetermined pressure along at least an end portion of the second cutting line up to the point of intersection;

a second step, following the first step, comprising lifting the blade of the cutter member away from the cutting material;

a third step, following the second step, comprising contacting the blade against the cutting material with a second predetermined force that is insufficient to cut through the cutting material, and moving the blade to the point of intersection at an end of the first cutting line at the corner portion; and a fourth step, following the third step, comprising pressing the blade of the cutter against the cutting material with a third predetermined force that is insufficient to cut through the cutting material and moving the blade along a predetermined portion of the end portion of the second cutting line extending along a predetermined distance from the point of intersection with the fourth predetermined force such that the predetermined portion of the first cutting line is not cut, pressing the blade against the cutting material at a fourth increased predetermined force greater than the third predetermined force and is sufficient to cut the cutting material, and further moving the blade along the first cutting line so as to cut another portion of the first cutting line spaced away from the predetermined portion of the first cutting line;

wherein after the second step, in the third step of the cut processing portion, the blade of the cutter is moved from the end of the second cutting line to the end of the first cutting line along the blade turning path so as to arrive at the end of the first cutting line while pressing the blade against the cutting material with the second predetermined force that is insufficient to cut through the cutting material.

10. A cutting machine as set forth in claim 9, wherein the cutting material comprises at least a first layer, wherein the first and fourth predetermined forces are the same and are sufficient to cut through the first layer and the second and third predetermined forces are the same and are insufficient to cut through the first layer.

11. A cutting machine as set forth in claim 9, wherein a time interval during which the blade of the cutter is lifted away from the cutting material is set to no less than 10 ms.

* * * * *